United States Patent [19]

Bollman

[11] 4,090,537

[45] May 23, 1978

[54] UNITARY, COMPOSITE, MULTI-LAYER WORK AREA

[76] Inventor: Clifford J. Bollman, 2000 E. Columbia Way, Vancouver, Wash. 98661

[21] Appl. No.: 769,109

[22] Filed: Feb. 16, 1977

[51] Int. Cl.[2] ..... B21F 27/00

[52] U.S. Cl. ..... 140/92.1; 223/109 R; 428/139

[58] Field of Search ..... 140/92.1; 248/454, 455, 248/456, 457; 428/322, 138, 139, 140; 223/109 R

[56] References Cited

U.S. PATENT DOCUMENTS

| | | | |
|---|---|---|---|
| 633,893 | 9/1899 | Olin | 223/109 R |
| 2,648,619 | 8/1953 | Alderfer | 428/138 |
| 3,016,317 | 1/1962 | Brunner | 428/138 |
| 3,104,195 | 9/1963 | Warnberg | 428/138 |
| 3,518,156 | 6/1970 | Windecker | 428/322 |
| 3,752,198 | 8/1973 | Fiorentino et al. | 140/92.1 |
| 3,920,872 | 11/1975 | Ollinger | 428/138 |

FOREIGN PATENT DOCUMENTS

| | | | |
|---|---|---|---|
| 1,208,271 | 10/1970 | United Kingdom | 248/455 |

*Primary Examiner*—Lowell A. Larson

[57] ABSTRACT

A unitary, composite, multi-layer work area is provided which can support a plurality of work pieces thereon. The work area includes a structure which comprises a pair of outer protective covering layers and inner rigid core means, respectively. Preferably, a pair of networks are disposed between the outer covering layers and the inner core means. Either or both of the networks can be replaced with a perforated, crush-proof structure. The layers of the structure are uniformly joined one to the other substantially along the entirety of their respective adjacent surfaces to form a laminate-like support structure. Fastening means passing within the subject work area are employed to maintain the work pieces in the requisite position. The structure can be supported in a fixed or in a plurality of adjustable positions with respect to the horizontal axis.

17 Claims, 12 Drawing Figures

FIG. 1
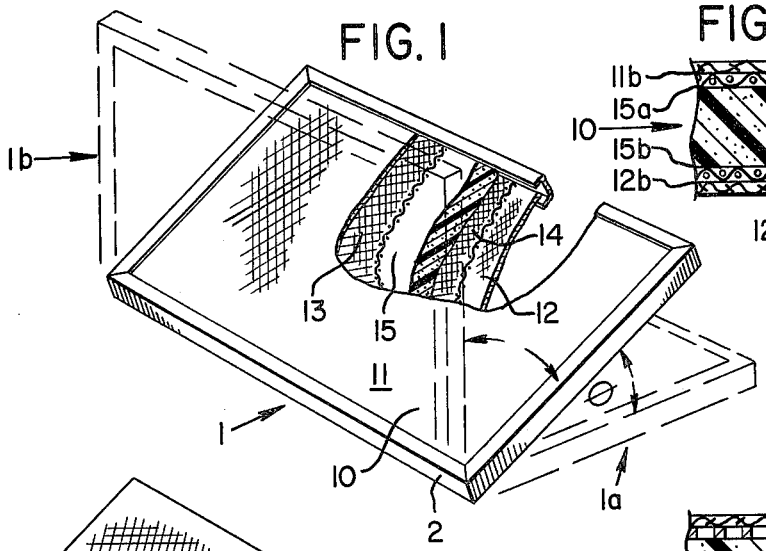
FIG. 2
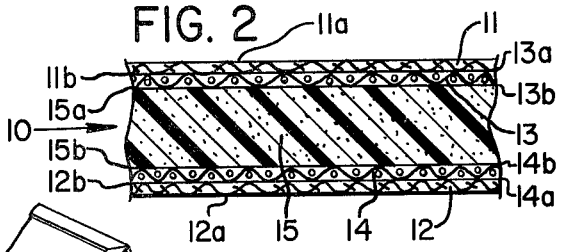
FIG. 4
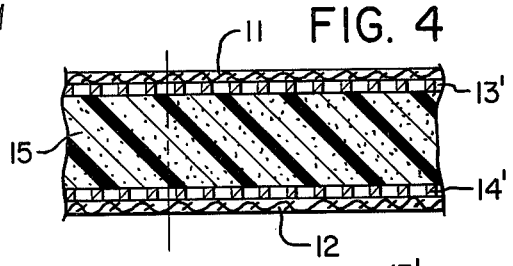
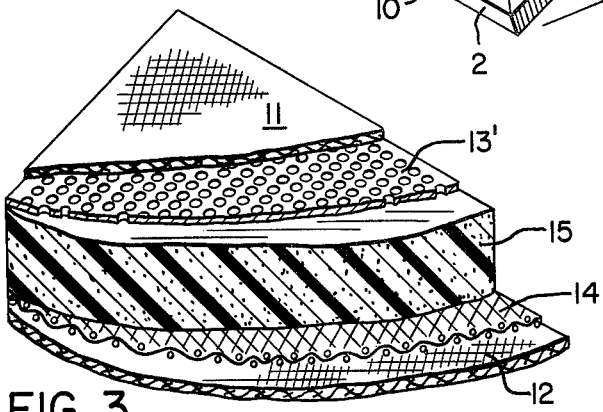
FIG. 3
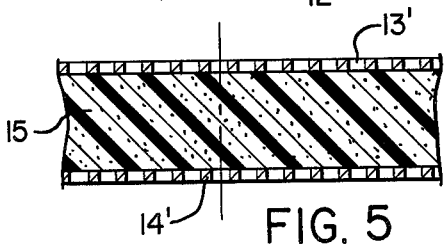
FIG. 5
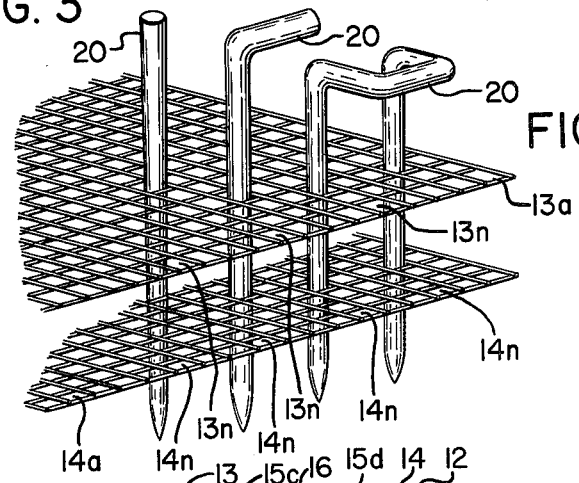
FIG. 6
FIG. 7
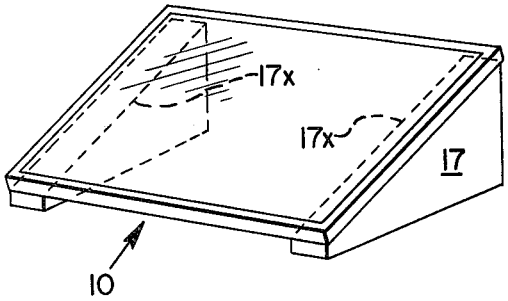
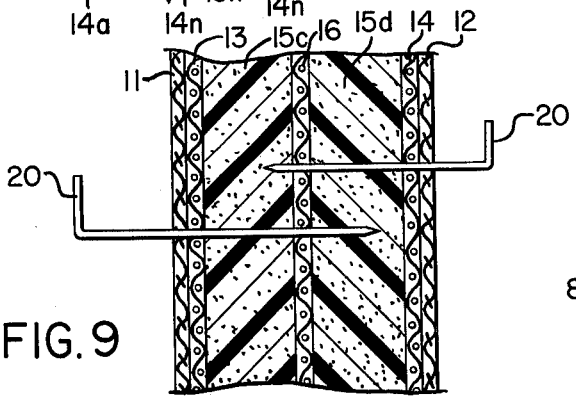
FIG. 9
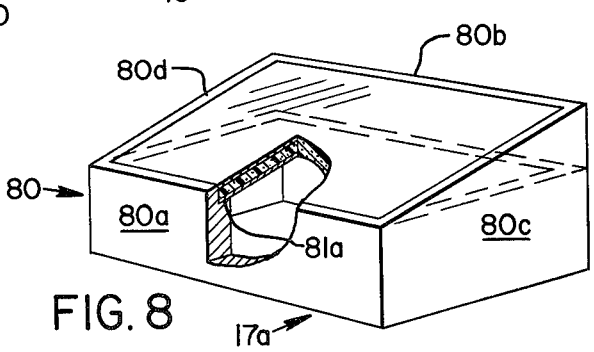
FIG. 8

UNITARY, COMPOSITE, MULTI-LAYER WORK AREA

BACKGROUND OF THE INVENTION

This invention relates to a unitary, composite, multi-layer structure, including a rigid, preferably substantially solid, inner permeable core means, and a pair of outer penetrable, protective covering layers. All the respective layers are uniformly joined one to the other, employing an adhesive or a bonding agent such as an epoxy resin, to form a laminate-like structure capable of permitting fastening means to penetrate therethrough interlockingly engaging with the work area system.

In one aspect of this invention, the subject structure can be employed, in part, as a modified, improved harness cable assembly board. In the past, these boards have been made from material such as plywood and the like, so that a blueprint or other layout drawing of the harness configuration can be affixed to the board for purposes of accurately wiring same. However, these boards must be permanently fabricated for use in a predetermined grid pattern on at least one face of the board. An example of this type of harness board assembly is shown in U.S. Pat. No. 3,653,411 to Mosher et al. In this particular board, the wiring assembly is attached by means of inserting guide pins into a guide means fabricated to accept a specified configuration of the guide pin, the series of holes 20 and 20*a* being predrilled to fit the guide pins in question. Thus, many additional boards must be fabricated when varying cable harness configurations are required due to the limitations imposed by the permanency in construction previously described.

To overcome the problems associated with the above described wooden boards, U.S. Pat. No. 3,633,096 to Bollman, U.S. Pat. No. 3,681,835 to Evans et al., and U.S. Pat. No. 3,946,768 to Fiorentino, each describe structural improvements in wire mesh jig boards. The above boards are similar in construction, each having flexible, light gauge wire mesh outer screens and an inner core layer. Receiving pins inserted therein for holding relatively light work pieces thereon, such as layout drawings and electrical wiring, are provided.

The flexible outer screen and inner core layers, respectively, of the Bollman, Evans, et al., and Fiorentino structures are non-uniformly interconnected one to the other, being joined together only by screws or by adhesive means at their peripheral edges via a peripheral retaining frame. The wire mesh screens of Fiorentino are also loosely embedded in a flexible core layer. None of the above structures are designed to provide protection for either the flexible, light gauge wire mesh screens or inner core portion of the jig board during use. Clearly, none of the prior art boards are crush-resistant. Thus, when in the above-described structures, a low-cost foam or particulate material is employed to form the core layer, it can be easily damaged or can be dissipated on continuing use. They do not provide the required structural integrity needed for adequate rigid support of work pieces fastened to the jig board.

Assembly work, such as performed in the electronics industry, in which jig boards and the like are used, is to a great extent time dependent. The faster and more efficiently workers complete a job, the higher their productivity will be. In addition, a worker is generally performing assembly operations employing relatively small parts, the work itself being quite detailed in nature. Thus, the more visually prominent and accessible the work surface and parts used during the wiring assembly, the easier it will be to perform the job in question. Prior art jig boards and associated equipment are maintained solely in a horizontal plane, generally supported on a flat surface such as a table, as opposed to being angularly disposed so that visibility and manual accessibility are greatly diminished. In instances where the boards are supported on a table or the like, pins cannot pass through the bottom of the jig board for maximum interlocking engagement, since they would scratch the table surface.

Finally, the inner core section, in its unprotected state, is subject to the effects of static electricity, a particularly critical problem in the electronics business. And, since the core is open to the atmosphere at all times, fire and moisture build-up can be problems.

SUMMARY OF THE INVENTION

The novel work area of the present invention generally comprises a unitary, composite, multi-layer laminate structure which overcomes the previously described problems associated with the prior art jig boards. More specifically, the subject structure includes a pair of outer penetrable protective coverings capable of permitting fastening means to be readily passed therethrough, and rigid inner core means, preferably substantially solid throughout the entirety of the core, which reinforce and rigidly maintain in a uniform manner the overall composite structure. If desired, the subject structure may include a plurality of networks, each containing a plurality of apertures, the networks being spaced apart in substantially parallel planes one with respect to the other. Generally, a pair of these networks are located between the outer layers and inner core means, respectively. Preferably, the openings in one network are non-aligned with respect to the openings in the other network. The multi-layers of the work area structure act together to exert a significant amount of torque on the fastening means for anchoring and maintaining the same in a designated position thereon. The respective outer protective layers and inner core means, as well as the networks of their employ, are all uniformly joined together substantially along the entirety of their respective adjacent surfaces to form a laminate-like support structure. More specifically, instead of the composite work area being inter connected only at its peripheral edge, as in the prior art structures, each of the component layers of the subject system are bonded to an adjacent layer so that a uniformly bonded unitary structure will be formed.

Another embodiment, a perforated, crush-proof layer is employed to replace one or both of the networks to provide a crush-resistant work area system useful, for example, as a partition, room divider, wall panel, and the like. If one of those networks is replaced by a crush-proof layer, as described above, a non-aligned system is created. If, however, a pair of perforated layers are used, a crush-proof structure will result in which the respective openings in each plate are aligned one with the other.

Contrary to the previously described prior art devices, the subject unitary, composite, multi-layer work area structure can be employed to support a large number of work pieces, including work pieces of varying sizes and shapes, even those having substantial weight. All this can be accomplished without causing the core section to be substantially deformed or dissipated on continuing use, while at the same time providing a uniform work surface having the requisite degree of structural integrity.

Because of the novel multi-layer laminate construction of the subject composite system, the work pieces and/or equipment can be readily supported in either a horizontal, and/or vertical, and/or angular disposition with respect to the horizontal axis of the structure. Thus the subject structure allows the person to conduct various operations on work pieces of differing sizes, shapes, and weights, the auxiliary equipment needed to perform these operations being maintained by fastening means on the same work surface.

For purposes of further accessibility and efficiency, the worker can have greater visibility and be even closer to the work pieces and auxiliary equipment when the subject composite structure is angularly disposed with respect to the normal horizontal axis. Because of the design of the subject work area, the work pieces, as well as the auxiliary equipment used to perform the various operations on the work pieces, are detachably anchored and maintained on the upper surface of the work area and are readily functional for use by a worker even though the multi-layered structure itself is angularly disposed.

Thus, in another embodiment of this invention, as hereinafter described, the work area structure is supported at a permanent angular disposition, or is adjustably supported for positioning in a multitude of predetermined angular positions, and/or in various vertical and/or horizontal attitudes.

Protective outer layers act to encapsulate and provide a fire a moisture barrier for the system and to permit control of the undesirable effects of static electricity. In a preferred embodiment, fire retardant outer layers, such as asbestos fabric and the like, can be employed. In addition the outer layers serve to keep the inner core clean, help to maintain it intact, and can be quite decorative and aesthetically pleasing to the eye.

DESCRIPTION OF THE DRAWINGS

FIG. 1 is the unitary, composite, multi-layer penetrable work area structure of the present invention disposed at an angle $\phi$ with respect to the horizontal axis of the structure, partially broken to show the inner structural components, the structure also being shown in phantom in respect to horizontal and vertical positions.

FIG. 2 is a detailed sectional view of the structure of FIG. 1.

FIG. 3 is a fragmentary, sectional, perspective view of the structure of FIG. 2 wherein one of the networks is replaced by a perforated crush-proof plate.

FIG. 4 is the detailed sectional view shown in FIG. 3, except that both of the networks have been replaced by perforated crush-proof plates.

FIG. 5 is the detailed sectional view depicted in FIG. 4 except that the outer coverings have been removed.

FIG. 6 is a fragmentary, exploded, prespective view of the networks as they are disposed one with respect to the other, having fastening means of various configurations passing there within.

FIG. 7 is a perspective view of the structure of FIG. 1 maintained at a fixed angular disposition on support means 17.

FIG. 8 is a perspective view of the structure of FIG. 1 maintained either at a fixed angle within support means 17' or, as shown in phantom, in a horizontal position.

FIG. 9 is a detailed sectional view of the structure of FIG. 1, except that a pair of rigid permeable core means are employed being separated one from the other by a third network. The structure can be employed to accept a plurality of fastening means in both sides, as shown therein.

DETAILED DESCRIPTION OF THE INVENTION

Figure 10:
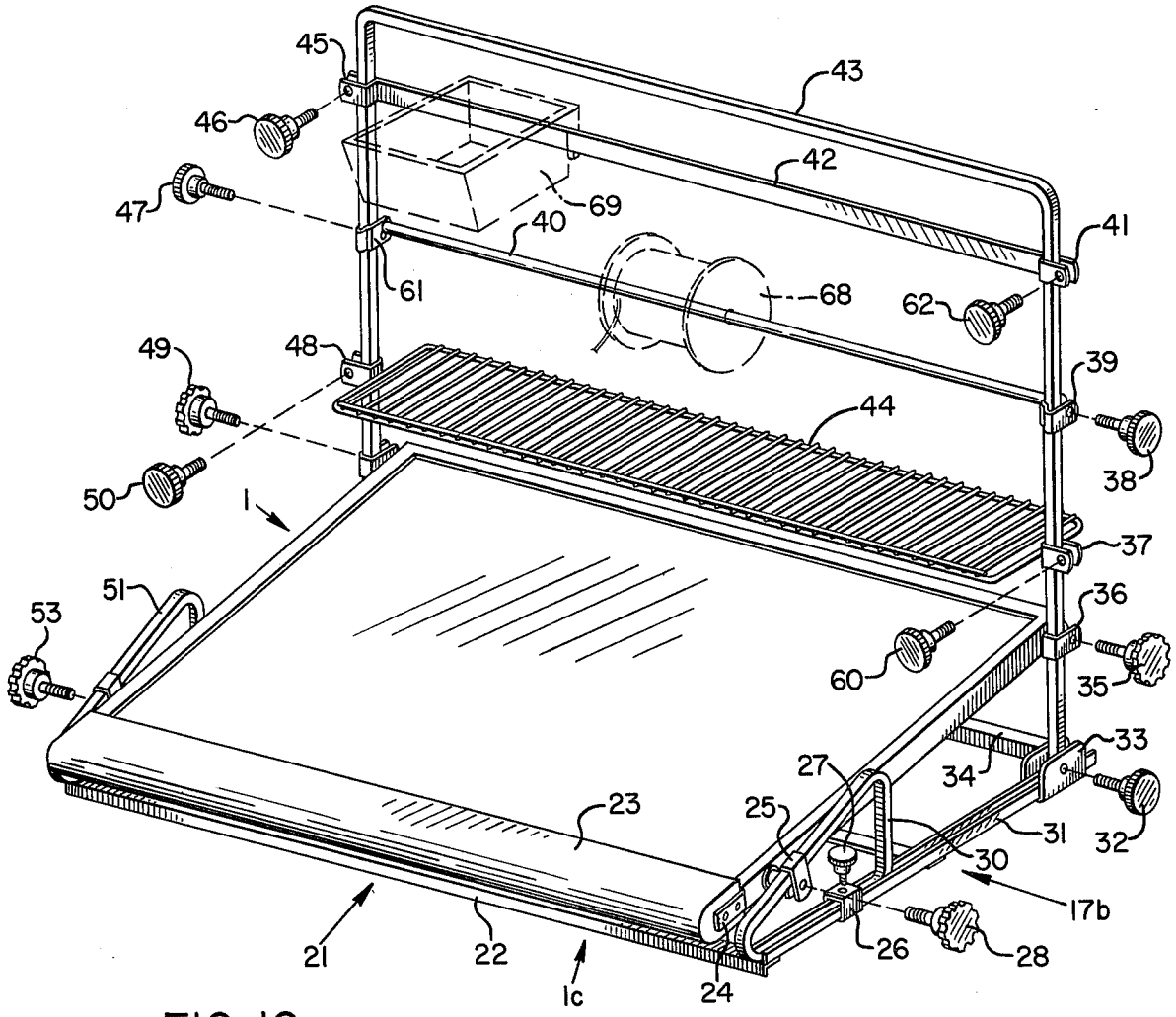
FIG. 10 is an exploded, perspective view of the unitary, multi-layer work area structure of FIG. 1 supported for adjustable movement to a plurality of vertical and/or horizontal and/or angular positions by an adjustable support structure.

Referring now to FIG. 1, a unitary, composite, multi-layered, penetrable work area 1 is provided including a multi-layer penetrable structural portion 10 surrounded by a peripheral frame 2. For added comfort in conducting normal operations on the surface of structure 1, peripheral frame 2 can be desirably padded so that workers can rest their arms thereon. Penetrable work area 1*a* (in phantom) pictured in FIG. 1 is positioned in the horizontal plane. Penetrable work area 1*b* (phantom) is shown in a vertical position. Work area 1 is depicted angularly disposed at an angle $\phi$ with respect to the normal horizontal axis of the structure. It should be noted that peripheral frame 2 as opposed to the prior art jig boards of Bollman, Evans et al., and Fieorentino, respectively, does not act as the sole means for holding together the various layers of the structure, but instead acts mainly as a decorative and protective outer border.

Multi-layered structure 10, as shown in FIGS. 1 and 2, is formed of a pair of yieldable, penetrable protective outer layers 11 and 12 attached along substantially the entirety of their adjacent inner surfaces 11*b* and 12*b* to the outer surface 13*a* and 14*a*, of a pair of networks 13 and 14, respectively, the inner surfaces 13*b* and 14*b* of respective networks 13 and 14 are in turn joined along their entirety to the outer surfaces 15*a* and 15*b* of inner rigid core means 15. Employing the configuration shown in FIG. 2, a support structure 10 is formed which is rigid and substantially non-pliant so that the outer surfaces 11*a* and 12*a* form a tough, flat area on which workers can perform their duties.

More specifically, yieldable outer layers 11 and 12, which encapsulate the inner structure components of the multi-layer work area 10, to provide a fire moisture barrier for the system, control static electricity, and maintain in tact the inner components of the work area structure, include a plurality of expandable openings which are capable of engaging fastening means 20 of various sizes which pass therethrough, for interlockingly supporting a plurality of work pieces on said composite structure, without damaging the structural integrity of said outer layers. The openings are included throughout the surface of outer layers 11 and 12 so that a plurality of fastening means 20 can be arranged in an unlimited number of predetermined configurations. Generally, these outer protective layers are formed of a woven or felted synthetic fabric or natural fabric which is preferably reinforced. For example, a piece of commercial carpeting, reinforced with a rubber or jute backing, can be used as outer layers 11 and 12. Preferably the reinforced backing is self-sealing in nature, employing materials such as a self-sealing polymer or the like. However, various polymeric coverings capable of allowing fastening means to pass therethrough can be employed. In a preferred embodiment, outer layers 11 and 12 comprise a fire retardant material such as asbestos, high temperature resistant nylon, and the like, to provide a heat shield for the structure. The outer layers, in addition to their respective functions serve to minimize pivoting by interlockingly engaging fastening means 20 when they are positioned within support structure 10.

If desired, a rigid, impact-resistant, substantially non yieldable layer 13', typically fabricated of metal or an impact resistant polymer, containing a plurality of permanent openings through which fastening means 20 may pass, can be employed in place of the hereinafter described networks 13 or 14 (See FIG. 3). This will permit a maximum torque to be exerted on the fastening means by the action of a substantially non yieldable layer 13' in combination with a more yieldable network 13 or 14 for retaining same in place as well as providing an overall structure having a more crush-resistant surface. For example, a polymeric or metal sheet having straight or staggered openings machined therein is preferably employed.

FIG. 4 depicts a multi-layer structure in which networks 13 and 14 are replaced by the previously described crush-resistant structures 13' and 14'. Typically, the openings in the respective networks 13' and 14' are in substantially horizontal alignment such that when fastening means pass therethrough, they are in a relatively parallel vertical disposition. If desired, crush-resistant structure 11 can be fabricated without protective layers 11 and 12 (FIG. 5). As most clearly seen in FIG. 6, networks 13 and 14 having a plurality of openings contained therein are spaced at a designated distance and positioned in substantially parallel planes one with respect to the other. Preferably, the networks are positioned so that the respective openings therein are in a non-aligned relationship one with the other. The networks 13 and 14, respectively, are preferably substantially yieldable in nature. The networks interact to maintain in an interlocking position fastening means 20 which pass through openings **13*a*–13*n* and 14*a*–14*n*, respectively, engaging said respective networks and maintaining in place on the surface of the support structure 10 work pieces and apparatus for performing various operations on the work pieces. Typically, networks 13 and 14** are formed of a mesh-like screening material, and are preferably constructed of metal or a synthetic polymeric material.

Core 15 acts as a spacer means for the unitary, composite, multi-layer structure 10 and is located between the respective outer layers 11 and 12. In addition, core 15 provides substantial rigidity and increases the overall impact-resistant nature of the structure 10. Accordingly, the inner core is generally formed of a high impact-resistant material through which fastening means 20 can readily pass. Typically, a light weight, rigid, high density polymeric foam, such as a high density polyurethane foam is employed as the core 15. Preferably the core 15 is substantially solid throughout its entirety for applying a further interlocking effect on the fastening means 20 passing therethrough.

In an important embodiment of this invention, structure 10 can be maintained in a plurality of angular positions with respect to the normal horizontal axis of the structure. The angular disposition of the structure generally is determined by the manner in which it is supported. The angular disposition of the structure 10 may be permanently fixed or may be adjustable FIG. 7 shows one manner in which the subject table can be maintained in a fixed angular disposition with respect to the normal horizontal axis of the structure. More specifically, structure 10 of FIG. 7 is sustained at a fixed angle on support means 17, which in this case comprise bolsters angularly disposed with respect to the horizontal surface on which they are supported. The angle is maintained with the horizontal by the angularly extending upper surface **17*x* of support means 17**.

FIG. 8 illustrates another type of support means **17*a* for maintaining the subject structure 10 in a fixed angular disposition, or alternatively, in a horizontal plane, with respect to the horizontal plane on which it is supported. More specifically, multi-layer structure 10 is stationarily supported within a framework 80, preferably a rigid framework of wood or metal construction, so that when fastening means 20 pass therethrough they will not mar the horizontal surface on which framework 80 is located. Framework 80 comprises front, rear, and side vertical support members 80*a*–80*d*, each having a notch 81*a*–81*d* at the upper edge thereof. When assembled, notches 81*a*–81*d* of framework 80 form a peripheral groove receiving and interlockingly maintaining within its confines the subject structure 10. As shown in phantom in FIG. 8, if desired, table 10 can also be supported in framework 80 in a horizontal plane at a predetermined distance above the horizontal surface on which framework 80** is located.

FIG. 9 depicts a further specific structure for maintaining a plurality of fastening means therein in which a pair of rigid core means **15*c* and 15*d* are employed as the inner spacer. Networks 13 and 14 are provided between rigid core means 15*c* and 15*d* and outer layers 11 and 12, while network 16 is located between core means 15*c* and 15*d*, respectively. Fastening means of various configurations can then be placed into either of the outer layers 11 and 12, through networks 13 and 14, as well as rigid core means 15*c* and 15*d*, and are anchored further by engagement with network 16**.

A preferred embodiment of this invention is a unitary, composite, multi-layer structure which is multi-positional and can therefore be maintained in a plurality of predetermined vertical and/or horizontal and/or angular positions by means of the adjustable support structure shown in FIG. 10. More specifically, penetrable table 1 is supported by adjustable structural framework **17*b* depicted as part of penetrable table assembly 21. More specifically, penetrable table assembly 21 comprises a unitary, composite, multi-layer, penetrable work area 1 which is similar in construction to the previously described structures depicted in FIGS. 1 and 2. Work area 1 is positioned above the surface on which it is supported by means of the hereinafter described multi-positional structural framework 17*b* which permits work area 1 to be maintained in a plurality of predetermined vertical and/or horizontal and/or angular positions, respectively. This provides workers with the flexibility of establishing a multitude of work area positions to suit their needs. Preferably, an arm rest 23 can be provided, which is generally padded, and is attached to penetrable work area 1 via arm rest connecting means 24 and 54, respectively, for the convenience and comfort of the worker. Work area 1 is adjustably connected to adjustable, multi-positional structural framework b as pictured in FIG. 10. Preferably, work area 1 is adjustably attached to both horizontal support member 1***c* and vertical support member 43, although it may be adjustably connected to only one of these structures. Structural framework 17*b* generally includes horizontal support member 1*c* adjustably attached to a vertical frame member 43. Preferably, work area 1 is adjustably attached to both horizontal support member 1*c* and vertical support frame 43, although it may be attached to only one of these structures. Horizontal support member 1*c* preferably includes front, rear, and side horizontal support means 22, 34, 31, and 57, respectively, joined at their respective ends, and is preferably rectangular in configuration.

Penetrable table 1 may be adjustably set and maintained at a plurality of angular and/or horizontal and/or vertical positions with respect to the horizontal axis of the structure, as provided in FIG. 10, by moving multi-positional work area 1 to the desired position with respect to horizontal support member 1*c*. Preferably, vertical frame member 43 may also be adjustably moved to further facilitate achieving predetermined position for the work area with respect to the horizontal support member 1*c*. In the structure 1 of FIG. 10, connecting means 31 and 51 adjustably and movably interconnect side horizontal support means 31 and 57 and penetrable work area 1 for facilitating adjustable movement of work area 1 with respect to horizontal support member 1*c*. Attachment means 26 and 55, including adjustment means 27 and 56, respectively, provide for interlocking adjustable engagement between connecting means 30 and 51, and side support means 31 and 57. Furthermore, attachment means 25 and 52, permanently joined to work area 1, provide for adjustable engagement between work area 1 and support means 30 and 51, and are interlockingly maintained in place by adjustment means 28 and 53.

Located at the rear of penetrable work area 1 are attachment means 36 and 63 which include adjustment means 35 and 29 for varying the movement of work area 1 with respect to vertical support member 43. Vertical support member 43 is pivotally attached to horizontal support member 1*c*. In the case of FIG. 10, vertical frame member 43 is pivotally connected to and moveable about, attachment means 33 and 59, which includes a lower angular adjustment means 32 and 58, respectively, located at the rear of side support means 31 and 57. Vertical support frame 43, which extends downwardly adjustably connecting with attachment means 33, 36, 59, and 63, supports auxiliary equipment employed by workers in performing their jobs. For example, a shelf 44 can be adjustably secured to rear support frame 43 by accessory attachment means 37 and 48, respectively, each of which includes accessory adjustment means 50 and 60. Similarly, dispensing rod 40, which supports spool 68, is adjustably maintained in a horizontal position by accessory attachment means 39 and 61 including accessory adjustment means 38 and 47. Parts bin hanger 42, which supports parts bin 69, is horizontally maintained via accessory attachment means 41 and 45, including accessory adjustment means 46 and 62. Preferably, all of the above attachment means comprise bracket means which are moveable from one position to another with respect to the support frame on which they are supported.

All the parts forming adjustable, multi-positional support structure 1 can be fabricated of tubular or channel-like members, for adjustable movement as previously described, and are preferably fabricated of metal or an impact-resistant polymeric material. It should be further stated that adjustable, penetrable table assemblies can also be fabricated which are adjustable with respect to vertical height, or front to rear positioning, or angular disposition, only. For example, if attachment means 25 and 52 are pivotally connected to side support members 31 and 57, respectively, the table would only be angularly adjustable by the movement of attachment means 36 and 63 with respect to vertical frame member 43 as hereinafter described.

In use, the unitary, composite, multi-layer penetrable work area 1 of the penetrable table assembly 21 is adjustable with respect to vertical height, its rear to front positioning, and finally with respect to its angular disposition.

To adjust the vertical height of the penetrable work area 1, adjustment means 28, 32, 35, 49, 53, and 58, are loosened so that penetrable table 1 and vertical frame member 43 can be moved forward or backward with respect to connecting means 30 and 51. Thus, the height of the table assembly 21 can be easily adjusted to the level best suited to the comfort and support of a given individual for sitting or standing during work operations. After the proper height is reached, the above adjustment means are tightened to lock the structure in the desired position.

Table 21 may also be adjustable to forward and backward positions by disengaging adjustment means 27, 32, 35, 49, 53, and 56, so that the work area 1 and vertical frame member 43 may be moved forward beyond the edge of a given surface on which it is supported or back to a position beyond the rear of the horizontal frame member. After the desired forward or rear position is achieved, the above adjustment means are tightened to lock the structure in place.

Finally, work area 1 may be adjustably moved to any operational angle from a horizontal to a vertical position, for improved visual and physical access. This is accomplished by disengaging adjustment means 32 and 58 of attachment means 33 and 59, as well as adjustment means 35 and 29 of attachment means 36 and 63, whereupon penetrable table area 1 can be moved to the desired angular disposition and locked in place by engagement of the above described adjustment means. For example, the table can be adjusted to a 90° angle with respect to the horizontal for operations best performed at a vertical position if such is the desire of the worker.

Figure 11:
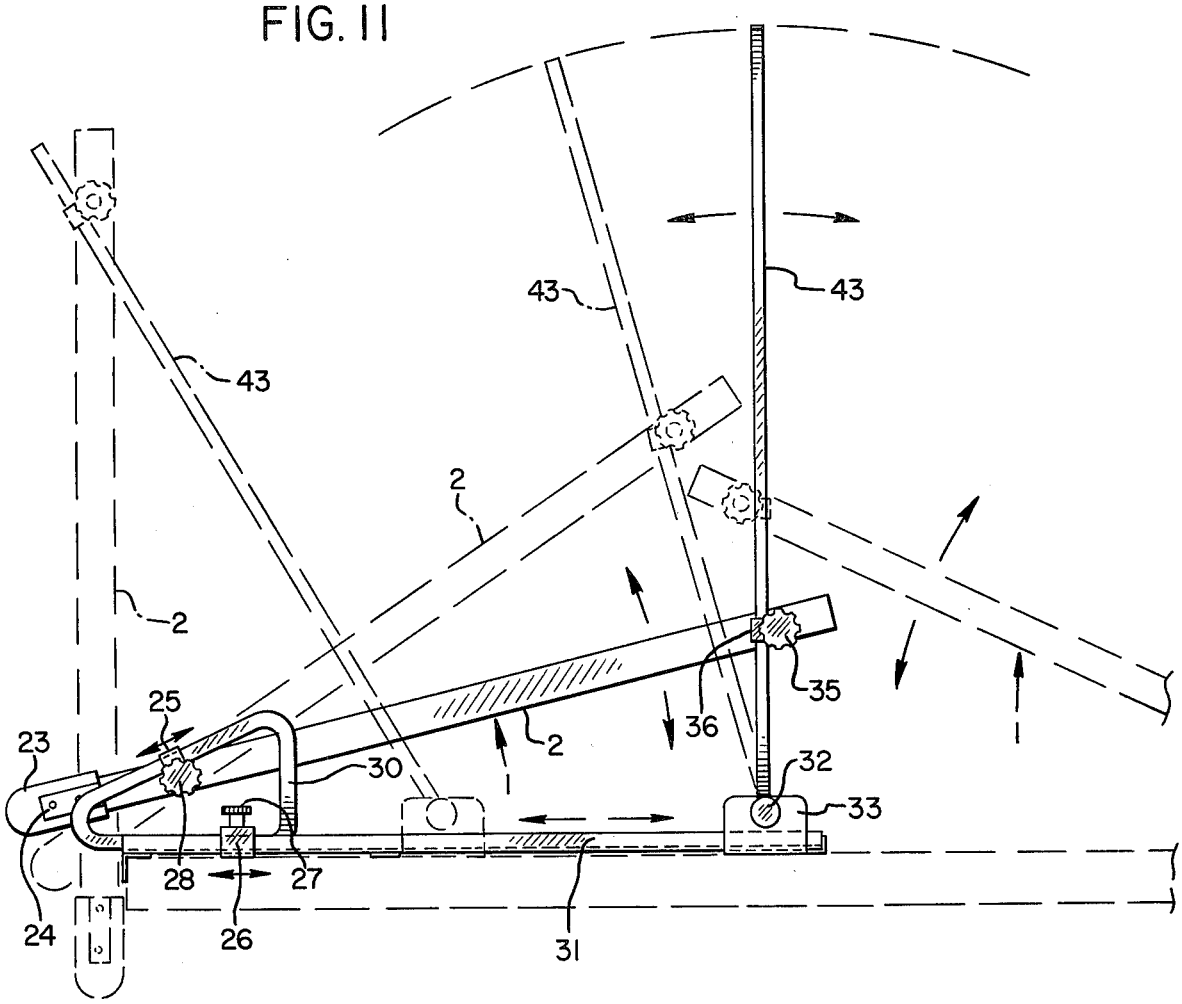
FIG. 11 is a side elevational view of the adjustable multi-positional structure of FIG. 10 depicting various positions to which the structure is adjustable, and further including an additional adjustable support structure if desired.

Various adjustable movements of the penetrable table assembly 21 are illustratively depicted in FIG. 11. Furthermore, additional work area structures may be pivotally attached to vertical support member 43 so that workers may use a single structural frame to support more than one penetrable table structure.

Figure 12:
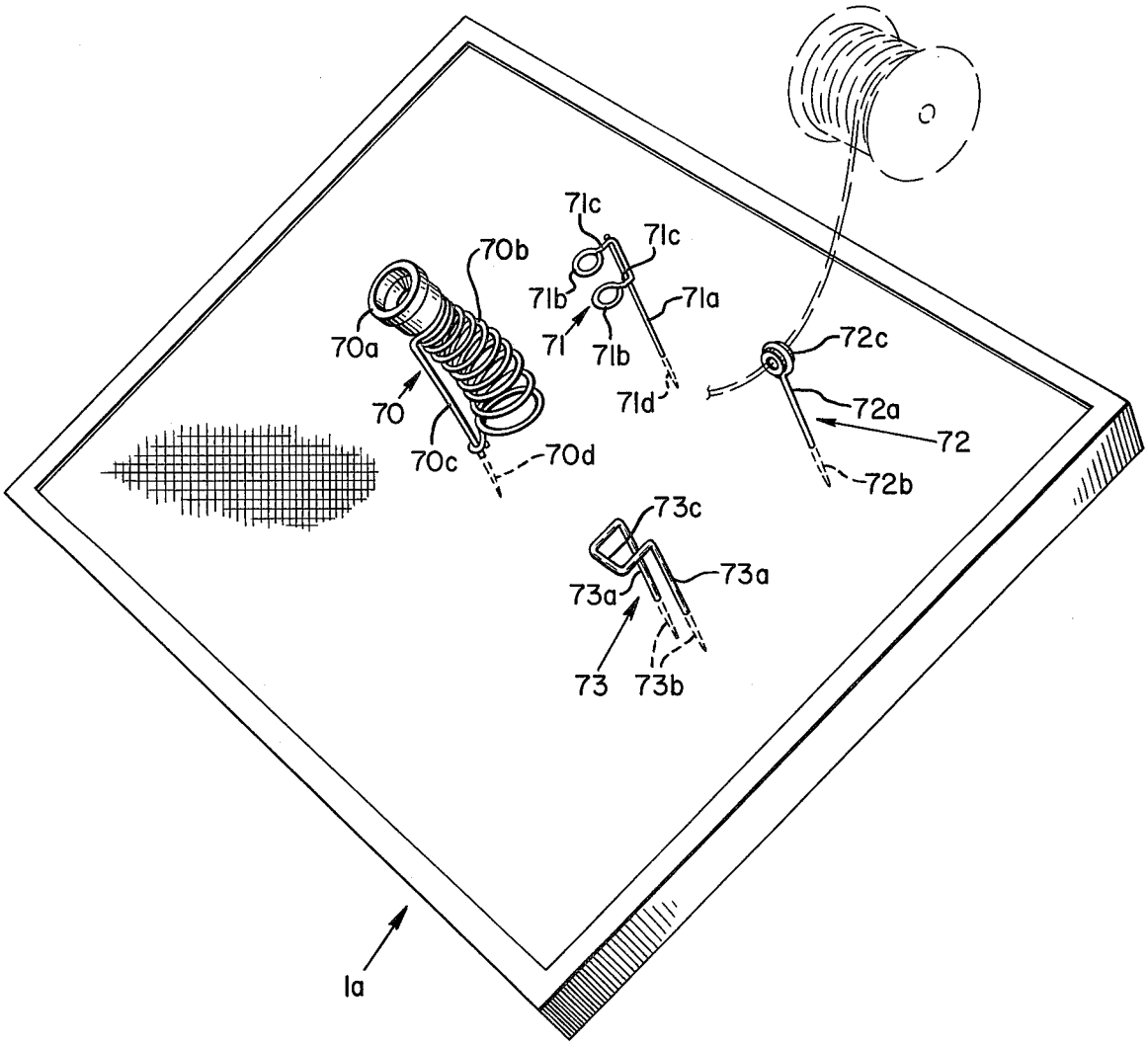
FIG. 12 is a perspective view of the structure of FIG. 1 supporting various means for holding, fastening and maintaining work pieces or auxiliary equipment thereon.

In FIG. 12 it is shown that fastening means 70, 71, 72 and 73, can be provided, for holding various equipment and accessories in place, which extend through the surface of the work area, and through the reverse side for maximum stability and retention. Thus, for instance, tool holders 70 and 71, wire control routing means 72, and double shank fastening means 73, and the like, may be employed using the fastening concepts so that a large number of accessories can be mounted into the table thereby eliminating holding platforms, weighted bases, and the like, thus conserving work space and allowing work items to be brought closer within the operator's working sphere. More specifically, tool holder 70 can be employed to hold tools such as soldering irons and the like. Tool holder 70 comprises a rigid neck-pieced 70*a* and connected thereto a swivelable, flexible, vertically-extending, spiral-like structure 70*b* which forms the base of the holder. A rib 70*c*, extending vertically and joined to the outside periphery of the spiral structure, provides structural support to said holder. The lower end 70*d* of the rib is terminated in a sharp point to facilitate passage of the lower end of the rib into the support structure. The tool is placed within the confines of the holder when not in use.

Bins may also be mounted on bin holder 68 and shelf 64. Wire, solder, and the like, in spool form can be placed on dispensing rod 40 for use as needed (See FIG. 10).

Tool holder 71 comprises a shank section 71*a*, terminating at its lower end in a point for purposes of facilitating passage of the shank into the support structure, and having a pair of tool holder rings 71*b* disposed in a vertical plane one with respect to the other, and connected one above the other to shank 71*a* by coupling means 71*c*. Tools retained by holder 71 are maintained within the confines of said holder when they are not in use.

Wire control routing means 72 includes a shank portion 72*a* terminating at its lower end in a point to facilitate passage thereof into the support structure. The holder has an eyelet 72*c* at its upper end for receiving wire or other like material therewithin and routing the wire to the proper place on the surface of the structure.

Another type of fastening means is a double shank fastening means 73 which comprises a pair of shanks 73*a* including pointed ends 73*b* and having a cross-post 73*c* connecting the respective shafts 73*a* of the subject fastening means.

All the respective fastening means 70–73 are preferably fabricated of metal or an impact-resistant polymeric material.

I claim:

1. A unitary, composite, multi-layer structure for supporting work pieces of differing sizes, shapes, and weights, and any auxiliary equipment required, said work piece support comprising rigid inner permeable core means which acts as a spacer means, and provides substantial rigidity and increases the overall impact-resistant nature of said structure, and outer protective covering layers for encapsulating the inner structural components of said structure, said outer protective covering layers including a plurality of expandable openings which are capable of engaging fastening means of varying sizes which pass therethrough for interlockingly supporting a plurality of work pieces thereon without damaging the structural integrity of said outer layers, the respective outer layers and core means being uniformly joined together one to the other substantially along the entirety of their respective adjacent surfaces to form a laminate-like structure capable of permitting a plurality of fastening means to penetrate said structure for interlocking engagement therewith.

2. The structure of claim 1, wherein the core means is substantially solid throughout its entirety for applying further torque to the fastening means passing therethrough.

3. The structure of claim 1, wherein the core means is formed of a high density material.

4. The structure of claim 1, wherein yieldable networks, containing a plurality of openings and spaced apart one with respect to the other, positioned in substantially parallel planes at a predetermined distance, are located between said outer protective layers and inner core means, respectively, said networks interacting to provide a plurality of retaining means for maintaining in an interlocking position fastening means which pass through said openings engaging said respective networks.

5. The structure of claim 4, wherein said networks are positioned so that the openings in each of said networks are in a non-aligned relationship one with respect to another.

6. The structure of claim 5, wherein one of said networks comprises a rigid, impact-resistant, substantially non-yieldable layer containing a plurality of permanent openings through which said fastening means may pass to provide, in combination with said yieldable network means, a maximum torque to be exerted on said fastening means.

7. The structure of claim 6, wherein each of said networks comprises rigid, impact-resistant, substantially non-yieldable layers, to provide a substantially crush-resistant structure, the respective openings in each of said networks being in substantially horizontal alignment such that when fastening means pass therethrough they are in relatively vertical disposition one with respect to the other.

8. The structure of claim 3, wherein said high density core means is fabricated of rigid, high-density polyurethane.

9. The structure of claim 1, wherein said outer protective layers are comprised of a fire retardant material to provide a heat shield means for said structure.

10. The structure of claim 1, which further includes support means for maintaining said structure in a fixed angular disposition with respect to the normal horizontal axis.

11. The structure of claim 1, which further includes support means for maintaining said structure in a fixed horizontal disposition with respect to the normal horizontal axis.

12. The structure of claim 1, which further includes support means for maintaining said structure in a fixed vertical disposition with respect to the normal horizontal axis.

13. The structure of claim 1, which further includes adjustable support means for maintaining said structure in a plurality of angular dispositions with respect to the normal horizontal axis.

14. The structure of claim 1, which further includes adjustable support means for maintaining said structure in a plurality of vertical dispositions with respect to the normal horizontal axis.

15. The structure of claim 1, which further includes adjustable support means for maintaining said structure in a plurality of horizontal dispositions with respect to the normal horizontal axis.

16. The structure of claim 1, which further includes adjustable multi-positional support means for maintaining said structure in a plurality of predetermined vertical and/or horizontal and/or angular positions.

17. The structure of claim 16, wherein said support means comprises a horizontal support member and a vertical support frame.

* * * * *